US008858168B2

(12) United States Patent
Loud et al.

(10) Patent No.: US 8,858,168 B2
(45) Date of Patent: Oct. 14, 2014

(54) VENTILATION SYSTEM AND METHOD FOR ASSEMBLING THE SAME

(75) Inventors: Richard Lynn Loud, Ballston Spa, NY (US); Carlos Andres Rodriguez, Albany, NY (US); Timothy Andrew Melsert, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 1077 days.

(21) Appl. No.: 12/041,465

(22) Filed: Mar. 3, 2008

(65) Prior Publication Data

US 2009/0220336 A1 Sep. 3, 2009

(51) Int. Cl.

*F04D 29/58* (2006.01)
*F04D 17/16* (2006.01)
*F04D 29/62* (2006.01)

(52) U.S. Cl.

CPC ..... *F04D 17/161* (2013.01); *F04D 29/626* (2013.01)
USPC ..... 415/175; 415/90; 415/119; 415/206

(58) Field of Classification Search

USPC ..... 415/90, 119, 175, 206, 76; 416/178, 416/187, 176
See application file for complete search history.

(56) References Cited

U.S. PATENT DOCUMENTS

| | | | | |
|---|---|---|---|---|
| 2,233,991 | A * | 3/1941 | Walters | 415/97 |
| 3,481,531 | A * | 12/1969 | MacArthur et al. | 416/203 |
| 4,172,697 | A * | 10/1979 | Schoen | 417/372 |
| 4,463,551 | A * | 8/1984 | Morris | 60/39.35 |
| 5,141,397 | A | 8/1992 | Sullivan | |
| 5,156,524 | A | 10/1992 | Forni | |
| 5,257,904 | A | 11/1993 | Sullivan | |
| 5,281,092 | A | 1/1994 | Sullivan | |
| 5,474,422 | A | 12/1995 | Sullivan | |
| 5,842,840 | A | 12/1998 | Korek et al. | |
| 6,034,451 | A | 3/2000 | El Mayas | |
| 6,178,733 | B1 * | 1/2001 | Nelson | 60/778 |
| 6,494,676 | B2 | 12/2002 | Yokoyama et al. | |
| 6,570,276 | B1 | 5/2003 | Morel et al. | |
| 6,798,079 | B2 * | 9/2004 | Nelson et al. | 290/2 |
| 7,284,952 | B2 | 10/2007 | Huang et al. | |
| 2003/0059293 | A1 * | 3/2003 | Chancey | 415/56.1 |
| 2009/0220336 | A1 | 9/2009 | Loud et al. | |

FOREIGN PATENT DOCUMENTS

| | | | |
|---|---|---|---|
| JP | 36004274 Y1 | | 3/1961 |
| JP | 470308697 | | 11/1972 |
| JP | 4730867 U | | 12/1972 |
| JP | 5036978 U | | 4/1975 |
| JP | 5258385 U | | 4/1977 |
| JP | 52147876 U | | 11/1977 |
| JP | 03070908 A | * | 3/1991 |
| JP | 2010216662 A | | 9/2010 |

OTHER PUBLICATIONS

Notice of Allowance issued in connection with corresponding JP Application No. 2009-036004 dated Oct. 29, 2013.

* cited by examiner

*Primary Examiner* — Edward Look
*Assistant Examiner* — Adam W Brown
(74) *Attorney, Agent, or Firm* — Armstrong Teasdale LLP

(57) ABSTRACT

A method for assembling a ventilation system is provided. The method includes providing a ventilation hood that includes a cover portion and a discharge portion extending from the cover portion. The cover portion includes a first aperture, an opposite second aperture, and a cavity therein, wherein an interior of the discharge portion is in flow communication with the cover portion cavity. The method also includes coupling a rotatable member at least partially within the ventilation hood, such that the rotatable member extends at least partially through at least one of the first and second apertures, and such that rotation of the rotatable member induces a windage-driven flow of fluid between a portion of the rotatable member and at least one of the first and second apertures.

13 Claims, 2 Drawing Sheets

VENTILATION SYSTEM AND METHOD FOR ASSEMBLING THE SAME

BACKGROUND OF THE INVENTION

The field of this invention relates generally to ventilation systems, and more particularly, to a method and a system for ventilating a power train enclosure in a power plant.

At least some known power plants include a steam turbine, an electric generator, and a rotatable member, such as a shaft, that couples the steam turbine to the electric generator. In many power plants, the burning of a combustible fuel, such as coal, produces thermal energy that boils water to produce steam. The steam is channeled through the turbine, which converts the thermal energy to mechanical energy by rotating the rotatable member coupling the turbine to the electric generator. The rotation of the rotatable member spins the electric generator to produce electricity.

During operation, rotation of the rotatable member generates heat and noise due to friction between the surfaces of the rotatable member and the surrounding air, and the level of noise can make for unpleasant operating conditions. To facilitate mitigating the noise level, at least some known systems employ an enclosure around the rotatable member. However, although the noise levels may be mitigated, the heat generated as the rotatable member is rotated may, over time, create excessive temperatures within the enclosure.

To facilitate preventing excessive temperatures within the enclosure, at least some known enclosures are ventilated. However, known ventilation systems may require a larger footprint, may increase the costs associated with the assembly, maintenance, and operation of the system, and may decrease the operating efficiency of the system.

BRIEF DESCRIPTION OF THE INVENTION

In one aspect, a method for assembling a ventilation system is provided. The method includes providing a ventilation hood that includes a cover portion and a discharge portion extending from the cover portion. The cover portion includes a first aperture, an opposite second aperture, and a cavity therein, wherein an interior of the discharge portion is in flow communication with the cover portion cavity. The method also includes coupling a rotatable member at least partially within the ventilation hood, such that the rotatable member extends at least partially through at least one of the first and second apertures, and such that rotation of the rotatable member induces a windage-driven flow of fluid between a portion of the rotatable member and at least one of the first and second apertures.

In another aspect, a ventilation apparatus for use with a rotatable member is provided. The ventilation apparatus includes a hood that has a cover portion and a discharge portion that extends from the cover portion. The cover portion is hollow and defines a cavity therein, and an interior of the discharge portion is coupled in flow communication with the cavity. The cover portion includes an outer surface including at least one of a first aperture and a second aperture defined thereon, wherein at least one of the first and second apertures is capable of receiving a fluid therethrough. The ventilation apparatus also includes a rotatable member extending at least partially through at least one of the first and second apertures such that rotation of the rotatable member induces a windage-driven flow of fluid inward through at least one of the first and second apertures and outward through the discharge portion.

In another aspect, a system for ventilating an area is provided. The system includes a ventilation hood including a cover portion and a discharge portion extending from the cover portion. The cover portion includes a first aperture, an opposite second aperture, and a cavity therein, wherein an interior of the discharge portion is in flow communication with the cover portion cavity. The system also includes a rotatable member coupled at least partially within the ventilation hood, wherein the rotatable member extends at least partially through at least one of the first and second apertures, and wherein rotation of the rotatable member induces a windage-driven flow of fluid between a portion of the rotatable member and at least one of the first and second apertures.

DETAILED DESCRIPTION OF THE INVENTION

Figure 1:
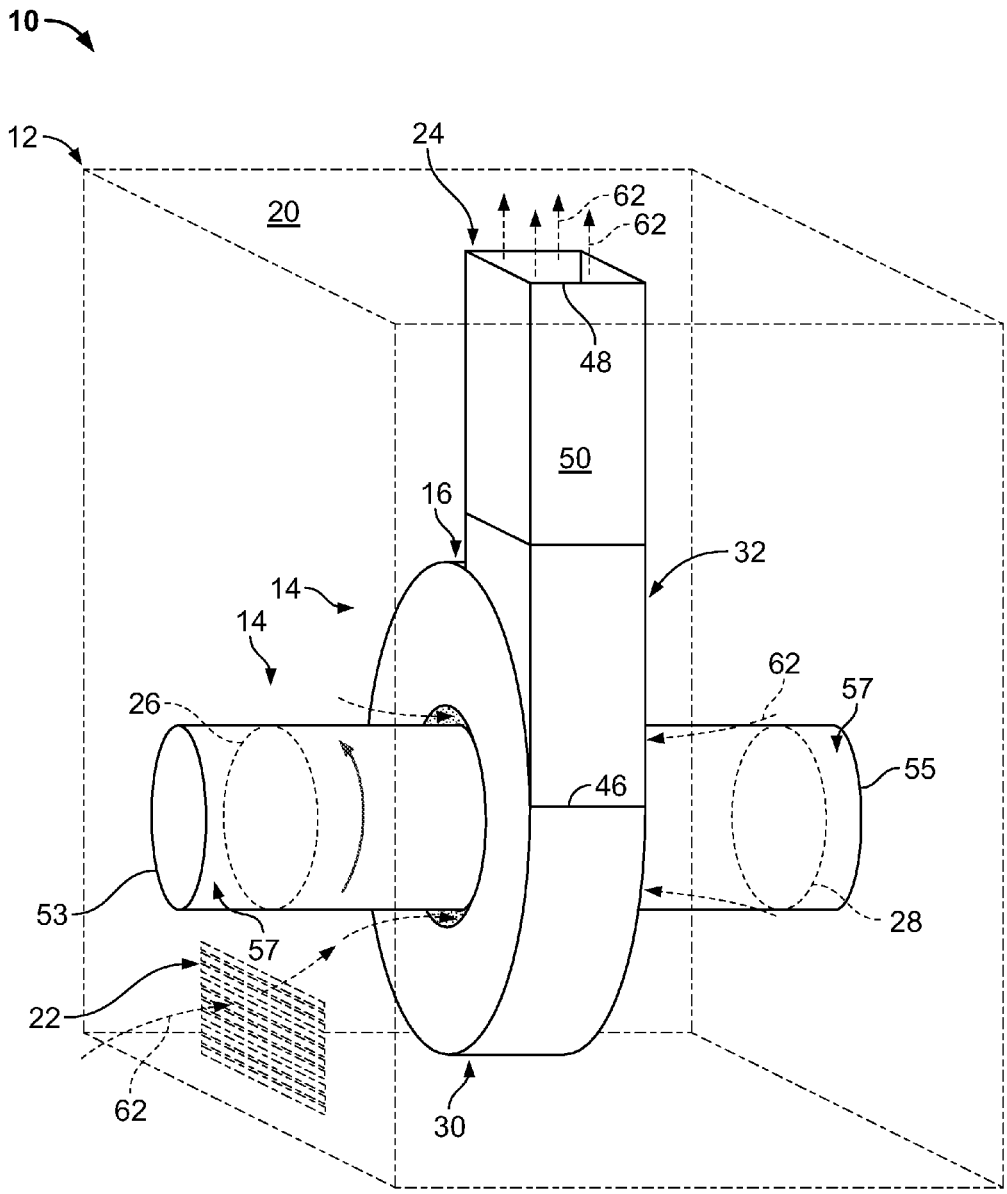
FIG. 1 is a perspective schematic view of an exemplary ventilation system.

FIG. 1 is a perspective schematic view of an exemplary ventilation system 10. Ventilation system 10 may include an enclosure for any rotatable member, as described herein. For example, ventilation system 10 may include an enclosure for a rotatable member that couples a motor to a pump or may include an enclosure for a rotatable member that couples a gas turbine to a steam turbine. While ventilation system 10 may be designed for use in various mechanical arrangements, in the exemplary embodiment, ventilation system 10 includes an enclosure 12 for a power train (not shown) of a power plant (not shown). Specifically, enclosure 12 at least partially houses a rotatable member 18 that couples together a turbine (not shown) and a load (not shown), such as an electric generator.

Ventilation system 10 includes enclosure 12 and a ventilation apparatus 14. Ventilation apparatus 14 includes a ventilation hood 16 and a rotatable member 18. Enclosure 12, as described in more detail below, facilitates mitigating noise generated by the rotation of rotatable member 18, and ventilation apparatus 14 facilitates ventilating enclosure 12. While enclosure 12 is described herein as facilitating mitigating noise, enclosure 12 may also facilitate various other purposes, such as, for example, weather protection, fire protection, and/or personnel protection. Alternatively, the primary purpose of enclosure 12 may be to facilitate ventilating rotatable member 18.

In the exemplary embodiments, enclosure 12 has a generally rectangular cross-sectional shape. In alternative embodiments, enclosure 12 may have any suitable size or shape that enables system 10 to function as described herein. More specifically, in the exemplary embodiment, enclosure 12 includes an outer wall 20 that includes a first opening 26 and a second opening 28 defined thereon. Openings 26 and 28 are sized to receive at least a portion of rotatable member 18 therethrough. Furthermore, openings 26 and 28 are disposed on opposing sides of enclosure 12, are substantially co-axially aligned, and are substantially symmetrical in size and shape. Alternatively, one of the first opening 26 and the second opening 28 may have a different size, shape, and/or orientation than the other opening 26 or 28. Additionally, in an alternative embodiment, enclosure 12 may not include openings 26 and 28, and rotatable member 18 may be completely housed within enclosure 12. Outer wall 20 also includes an inlet 22 and an outlet 24 defined on adjacent sides of enclosure 12. Inlet 22 and outlet 24 enable a fluid 62 to flow through enclosure 12 from inlet 22 through outlet 24. Alternatively, inlet 22 and outlet 24 may be positioned on opposing sides of enclosure 12 or may be positioned on a single side of enclosure 12. While inlet 22 and outlet 24 are spaced a distance apart on outer wall 20 in the exemplary embodiment, inlet 22 and outlet 24 may be formed together in an alternative embodiment. Additionally, enclosure 12 may include a plurality of inlets 22 and/or a plurality of outlets 24 defined thereon.

Figure 2:
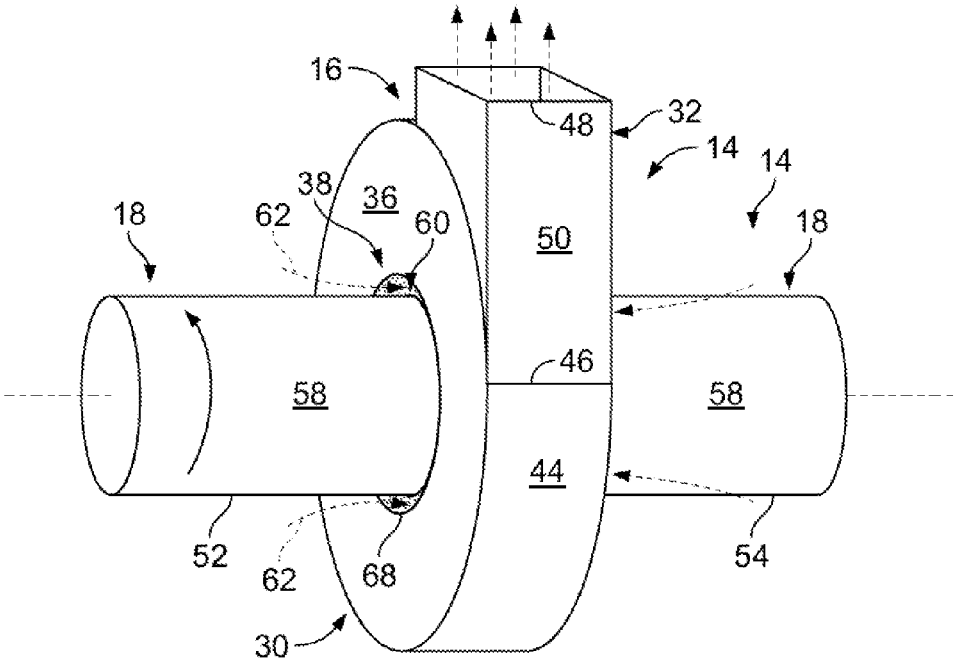
FIG. 2 is a schematic view of an exemplary ventilation apparatus used with the system shown in FIG. 1.
Figure 3:
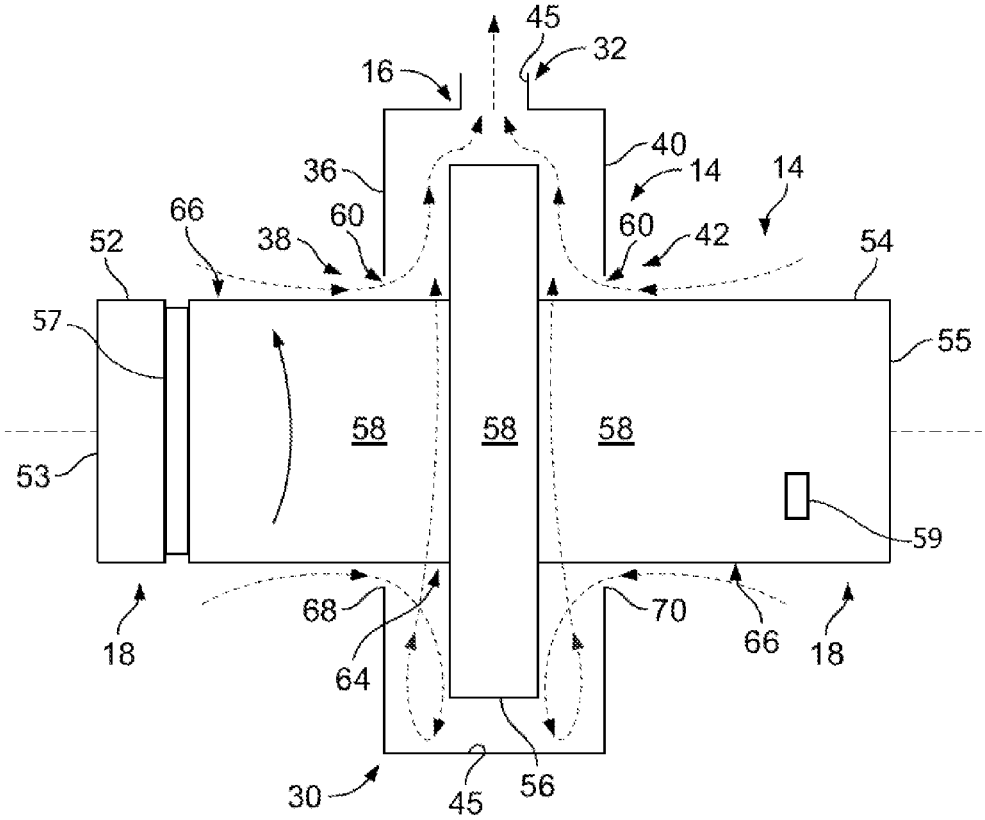
FIG. 3 is a cross-sectional view of the exemplary ventilation apparatus shown in FIG. 2.

FIG. 2 is a schematic illustration of an exemplary ventilation apparatus 14 that may be used with ventilation system 10 (as shown in FIG. 1), and FIG. 3 is a cross-sectional view of the ventilation apparatus 14 shown in FIG. 2. In the exemplary embodiment, ventilation apparatus 14 includes ventilation hood 16 and rotatable member 18.

As shown in FIG. 2, ventilation hood 16 includes a cover portion 30 and a discharge portion 32, wherein cover portion 30 and discharge portion 32 are hollow. More specifically, cover portion 30 includes a first face 36, an opposite second face 40 (shown in FIG. 3), and a peripheral face 44 that extends between first face 36 and second face 40. First face 36 is substantially parallel to second face 40, and faces 36 and 40 include an aperture 38 and an aperture 42 (shown in FIG. 3), respectively. Alternatively, one of first face 36 and second face 40 may be without respective aperture 38 or 42 and may be substantially solid, such that cover portion 30 includes only one aperture 38 or 42. Moreover, apertures 38 and 42 are generally circular in shape and are substantially concentrically aligned, such that cover portion 30 is generally toroidal and generally symmetrical in shape. Alternatively, cover portion 30 may have any suitable size or shape that enables ventilation hood 16 to function as described herein. Moreover, in an another embodiment, apertures 38 and/or 42 may have any non-circular shape that enables hood 16 to function as described herein.

In the exemplary embodiment, discharge portion 32 includes a first end 46, a second end 48, and a body 50 extending between ends 46 and 48. First end 46 is coupled in flow communication with cover portion 30, and, as shown in FIG. 1, second end 48 is either coupled in flow communication with enclosure outlet 24 or positionable in flow communication with enclosure outlet 24 to enable a fluid 62 to flow from cover portion 30 into discharge portion 32 through first end 46 and to be discharged from discharge portion 32 through second end 48. Although discharge portion 32 has a generally rectangular cross-sectional profile in the exemplary embodiment, discharge portion 32 may have any cross-sectional shape that enables hood 16 to function as described herein. Cover portion 30 and discharge portion 32 are each positioned within enclosure 12, and more specifically, each portion 30 and/or 32 may be coupled within enclosure 12 using any suitable means. Alternatively, second end 48 of discharge portion 32 may extend beyond enclosure outer wall 20.

In another embodiment, an interior surface 45 (shown in FIG. 3) of ventilation hood 16 may include a silencer mechanism (not shown) and/or may be lined with a thermal insulation (not shown) and/or an acoustic insulation (not shown) to facilitate reducing heat dissipation and/or noise propagation. Specifically, the silencer mechanism and/or the acoustic insulation may be positioned within body 50 of discharge portion 32 such that the silencer mechanism and/or the acoustic insulation extends along a portion of interior surface 45 proximate second end 48 or extends from first end 46 to second end 48, such that noise is facilitated being mitigated as fluid 62 exits discharge portion 32 through second end 48.

In the exemplary embodiment, as shown in FIG. 3, rotatable member 18 includes a first shaft 52 extending from a first end 53, a second shaft 54 extending from a second end 55, and a coupler 56 for coupling first shaft 52 to second shaft 54 between first end 53 and second end 55, wherein shafts 52 and 54 have approximately the same diameter and are coupled substantially concentrically together. In an alternative embodiment, rotatable member 18 may include other rotatable components such as, but not limited to, other shafts, at least one sphere, and/or a disc. In the exemplary embodiment, rotatable member 18 has an outer surface 58 that is substantially smooth. Alternatively, at least a portion of outer surface 58 may be configured to generate windage when rotatable member 18 is rotated. More specifically, at least a portion of outer surface 58 may have a predetermined roughness that facilitates increasing windage between outer surface 58 and surrounding fluid 62 during rotation of rotatable member 18. For example, at least a portion of outer surface 58 may be formed with indentations (not shown) or grooves 57 that facilitate increasing windage upon rotation of rotatable member 18. Additionally, at least a portion of outer surface 58 may include at least one protuberance 59 that extends therefrom, such as, but not limited to, a thread or an impeller coupled to or formed with rotatable member 18. Moreover, in another embodiment, at least one bolt hole (not shown) may be formed in coupler 56 and at least one bolt head (not shown) and/or nut (not shown) may extend from coupler 56, facilitating coupling first shaft 52 to second shaft 54.

As shown in FIG. 3, in the exemplary embodiment, rotatable member 18 extends through both apertures 38 and 42, such that at least a portion 64 of rotatable member 18 is within ventilation hood 16 and at least a portion 66 of rotatable member 18 is external of ventilation hood 16. More specifically, at least a portion 66 of rotatable member 18 is external of ventilation hood 16 proximate first face 36, and at least a portion 66 of rotatable member 18 is external of ventilation hood 16 proximate second face 40. Alternatively, if cover portion 30 includes only one of apertures 38 and 42, rotatable member 18 may extend through the one aperture 38 or 42, such that one of first end 53 and second end 55 is within cover portion 30 and such that at least a portion 66 of rotatable member 18 is external of cover portion 30. In the exemplary embodiment, coupler 56 rotatably couples first shaft 52 to second shaft 54 within ventilation hood 16. In an alternative embodiment, rotatable member 18 may be a unitary shaft.

In the exemplary embodiment, a first edge 68 and a second edge 70 of cover portion 30 define apertures 38 and 42 respectively, and rotatable member 18 extends through apertures 38 and/or 42 such that a gap 60 separates outer surface 58 of rotatable member 18 from edges 68 and/or 70. As such, fluid 62 is capable of entering cover portion 30 through gap 60.

As shown in FIG. 1, rotatable member 18 extends through first opening 26 and second opening 28 of enclosure 12. More specifically, rotatable member 18 extends through enclosure 12 such that at least a portion 57 (shown in FIG. 1) of rotatable member 18 is external of enclosure 12 on opposing sides of enclosure 12. Alternatively, rotatable member 18 may be completely encased within enclosure 12 or may extend through only one of openings 26 and 28.

Upon rotation of rotatable member 18, as illustrated in FIG. 3, fluid 62 is caused to flow through ventilation hood 16. For example, rotation of rotatable member 18 generates windage between outer surface 58 and surrounding fluid 62 within cover portion 30, such that an area of lower pressure (not shown), when compared to ambient pressure, is formed within cover portion 30, wherein the area of lower pressure (not shown) causes fluid 62 to flow through ventilation hood 16, which causes fluid 62 to enter enclosure 12 through inlet 22. Broadly, the lower pressure (not shown) formed within cover portion 30 by the rotation of rotatable member 18 causes fluid 62 to flow into enclosure 12 through inlet 22, into cover portion 30 through gap 60, through discharge portion 32, and out of enclosure 12 and into the ambient through outlet 24, thereby generating a windage-driven flow of fluid 62 through enclosure 12 in order to ventilate enclosure 12.

In each embodiment, the above-described ventilation methods and systems facilitate ventilating an area. More specifically, in each embodiment, the above-described ventilation apparatus generates a windage-driven airflow through an enclosure in order to facilitate expelling from the enclosure, without the use of supplemental, motor-driven ventilation fans and the like, fluid and heat therein. Accordingly, the above-described methods and systems facilitate cooling the interior of a power train enclosure in a power plant and expelling any unwanted fluids from within the enclosure, while reducing energy costs associated with ventilating the enclosure by eliminating the need for supplemental, motor-driven ventilation systems.

Exemplary embodiments of ventilation methods and systems are described above in detail. These ventilation methods and systems are not limited to the specific embodiments described herein, but rather, components of the methods and systems may be utilized independently and separately from other components described herein. For example, the ventilation apparatus described above may have other industrial or consumer applications and is not limited to practice with energy systems alone, as described herein. Rather, the present invention may be implemented and utilized in connection with many other products and systems.

While the invention has been described in terms of various specific embodiments, those skilled in the art will recognize that the invention can be practiced with modification within the spirit and scope of the claims.

What is claimed is:

1. A method for assembling a ventilation system, said method comprising:

providing an enclosure that includes an inlet and an outlet;

positioning a ventilation hood within the enclosure, wherein the ventilation hood includes a cover portion and a discharge portion extending from the cover portion, wherein the discharge portion includes a first end, a second end, and a body extending therebetween, the cover portion including a first aperture, an opposite second aperture, and a cavity therein, and wherein an interior of the discharge portion is in flow communication with the cover portion cavity;

coupling the discharge portion first end to the cover portion;

coupling the discharge portion second end to the enclosure outlet such that fluid is channeled through the discharge portion first end and is discharged through the discharge portion second end;

coupling an acoustic liner to an inner surface of the discharge portion; and coupling a first shaft and a second shaft of a rotatable member together, wherein the first shaft extends from the ventilation hood towards a turbine and the second shaft extends from the ventilation hood towards a load, and wherein the first and second shafts are rotatably coupled together within the ventilation hood with a coupler, wherein the rotatable member does not include an impeller coupled thereto, wherein the rotatable member extends at least partially through the first and second ventilation hood apertures and through a first enclosure opening and a second enclosure opening that are each separate from the enclosure inlet, and such that only the rotation of the first and second shafts induce a windage-driven flow of fluid that forces fluid into the enclosure from outside the enclosure through the enclosure inlet, into the cover portion cavity of the ventilation hood from inside the enclosure through the first and second ventilation hood apertures, and to the outside of the enclosure through the enclosure outlet all in succession.

2. The method in accordance with claim 1, further comprising:

coupling the rotatable member to the ventilation hood such that at least a portion of the rotatable member is positioned within the cover portion.

3. The method in accordance with claim 1, further comprising:

coupling the rotatable member to the ventilation hood such that at least a portion of the coupler is rotatably coupled within the cover portion.

4. The method in accordance with claim 1, wherein providing the ventilation hood further comprises providing the ventilation hood with the first and second apertures being substantially symmetrical.

5. A ventilation apparatus for use with an enclosure including an inlet and an outlet, said ventilation apparatus comprising:

a hood comprising a cover portion and a discharge portion that extends from said cover portion, said cover portion is hollow and defines a cavity therein, said discharge portion comprising a first end, a second end, and a body extending therebetween, said discharge portion first end is coupled to said cover portion and said discharge portion second end is coupled to the enclosure outlet such that fluid is channeled through said discharge portion first end and is discharged through said discharge portion second end, said discharge portion further comprising an inner surface and an acoustic insulation coupled to said inner surface, said cover portion comprises an outer surface comprising at least one of a first aperture and a second aperture defined thereon, at least one of said first and second apertures capable of receiving a fluid therethrough; and a rotatable member comprising a first shaft and a second shaft, said first shaft extending from said hood towards a turbine, said second shaft extending from said hood towards a load, said first said second shafts are rotatably coupled together within said hood with a coupler, wherein said rotatable member does not include an impeller coupled thereto, wherein said rotatable member extends at least partially through at least one of said first and second apertures that are each separate from the enclosure inlet, and such that only the rotation of said first shaft and said second shaft induces a windage-driven flow of fluid inward into the enclosure from outside the enclosure through the inlet of the enclosure, into said cover portion of said hood from inside the enclosure through at least one of said first and second apertures, and outward to outside of said enclosure through said discharge portion all in succession.

6. The apparatus in accordance with claim 5, wherein at least a portion of said first and said second shafts are positioned within said cover portion.

7. The apparatus in accordance with claim 5, wherein at least a portion of said coupler is rotatably coupled within said cover portion.

8. The apparatus in accordance with claim 5, wherein said first and second apertures are substantially symmetrical.

9. A system for ventilating an area, said system comprising:

an enclosure comprising an inlet and an outlet;

a ventilation hood comprising a cover portion and a discharge portion extending from said cover portion, said cover portion comprising a first aperture, an opposite second aperture, and a cavity therein, said discharge portion comprising a first end, a second end, and a body extending therebetween, said discharge portion first end is coupled to said cover portion and said discharge portion second end is coupled to said enclosure outlet such that fluid is channeled through said discharge portion first end and is discharged through said discharge portion second end, said discharge portion further comprising an inner surface and an acoustic insulation coupled to said inner surface; and a rotatable member comprising a first shaft and a second shaft, said first shaft extending from said hood towards a turbine, said second shaft extending from said hood towards a load, wherein said first and said second shafts are rotatably coupled together within said ventilation hood with a coupler, wherein said rotatable member does not include an impeller coupled thereto, said rotatable member extending at least partially through at least one of said first and second apertures and through a first enclosure opening and a second enclosure opening that are each separate from the enclosure inlet, wherein only the rotation of said first and said second shafts induce a windage-driven flow of fluid inward into said enclosure through said inlet of said enclosure, into said cover portion from inside said enclosure through at least one of said first and second apertures, and outward to outside of said enclosure through said discharge portion all in succession.

10. The system for ventilating an area in accordance with claim 9, wherein said enclosure further comprises an outer wall comprising a first opening and a second opening, said rotatable member extending at least partially through said first and second openings and wherein rotation of said rotatable member induces a windage-driven flow of fluid through at least one of said first and second openings.

11. The system for ventilating an area in accordance with claim 9, wherein at least a portion of said first and said second shafts are positioned within said cover portion.

12. The system for ventilating an area in accordance with claim 9, wherein at least a portion of said coupler is rotatably coupled within said cover portion.

13. The system for ventilating an area in accordance with claim 9, wherein said first and second apertures are substantially symmetrical.

* * * * *